US008981883B2

(12) United States Patent
Naka et al.

(10) Patent No.: US 8,981,883 B2
(45) Date of Patent: Mar. 17, 2015

(54) CONTACT MECHANISM AND ELECTROMAGNETIC CONTACTOR USING SAME

(71) Applicants: Fuji Electric FA Components & Systems Co., Ltd., Chuo-ku, Tokyo (JP); Fuji Electric Co., Ltd., Kawasaki-shi, Kanagawa (JP)

(72) Inventors: Yasuhiro Naka, Kounosu (JP); Kouetsu Takaya, Kounosu (JP); Kenji Suzuki, Kounosu (JP)

(73) Assignees: Fuji Electric FA Components & Systems Co., Ltd., Tokyo (JP); Fuji Electric Co., Ltd., Kawasakishi, Kanagawa (JP)

( * ) Notice: Subject to any disclaimer, the term of this patent is extended or adjusted under 35 U.S.C. 154(b) by 0 days.

(21) Appl. No.: 14/289,127

(22) Filed: May 28, 2014

(65) Prior Publication Data

US 2014/0266522 A1 Sep. 18, 2014

Related U.S. Application Data

(62) Division of application No. 13/640,612, filed as application No. PCT/JP2011/003376 on Jun. 14, 2011.

(30) Foreign Application Priority Data

Jul. 27, 2010 (JP) ..... 2010-168176

(51) Int. Cl.
*H01H 1/00* (2006.01)
*H01H 1/06* (2006.01)
(Continued)

(52) U.S. Cl.
CPC . *H01H 1/06* (2013.01); *H01H 1/54* (2013.01); *H01H 50/546* (2013.01); *H01H 1/50* (2013.01)
USPC ..... 335/196; 335/133

(58) Field of Classification Search
CPC ..... H01H 1/54; H01H 50/54; H01H 31/24; H01H 77/101; H01H 50/546; H01H 3/222; H01H 50/00; H01H 1/20
USPC ..... 335/78, 128, 133, 196
See application file for complete search history.

(56) References Cited

U.S. PATENT DOCUMENTS 3,465,270 A 9/1969 Schattler
4,467,301 A 8/1984 Goodrich
(Continued)

FOREIGN PATENT DOCUMENTS

CN 101231923 A 7/2008
JP S43-6568 Y1 3/1968
(Continued)

OTHER PUBLICATIONS

Europe Patent Office, "Search Report for EP 11811975.9," Oct. 9, 2014.
(Continued)

*Primary Examiner* — Bernard Rojas
(74) *Attorney, Agent, or Firm* — Manabu Kanesaka

(57) ABSTRACT

A contact mechanism is capable of, without enlarging the entire configuration thereof, preventing the generation of an electromagnetic repulsion that opens a movable contact upon application of a current, and also provides an electromagnetic contactor that uses this contact mechanism. A contact mechanism has a fixed contact and a movable contact that are inserted in a current-carrying path. In the contact mechanism, the fixed contact or the movable contact is formed into an L-shape or a U-shape so as to generate a Lorentz force that acts against an electromagnetic repulsion in an opening direction, which is generated between the fixed contact and the movable contact upon application of a current.

2 Claims, 5 Drawing Sheets

(51) Int. Cl.

| | |
|---|---|
| ***H01H 1/54*** | (2006.01) |
| ***H01H 50/54*** | (2006.01) |
| ***H01H 1/50*** | (2006.01) |

(56) References Cited

U.S. PATENT DOCUMENTS

| | | | | |
|---|---|---|---|---|
| 5,448,033 | A * | 9/1995 | Leone et al. | 218/146 |
| 6,700,466 | B1 * | 3/2004 | Yamamoto et al. | 335/132 |
| 8,698,582 | B2 * | 4/2014 | Uchida | 335/147 |
| 8,841,979 | B2 * | 9/2014 | Uchida | 335/195 |
| 2009/0096559 | A1 * | 4/2009 | Yano et al. | 335/187 |
| 2013/0229247 | A1 * | 9/2013 | Tachikawa et al. | 335/196 |
| 2013/0335175 | A1 * | 12/2013 | Tachikawa et al. | 335/147 |

FOREIGN PATENT DOCUMENTS

| | | | |
|---|---|---|---|
| JP | S60-41724 | A | 3/1985 |
| JP | 2008-226547 | A | 9/2008 |

OTHER PUBLICATIONS

China Patent Office, "Office Action for CN 201180018392.9," Dec. 29, 2014.

* cited by examiner

CONTACT MECHANISM AND ELECTROMAGNETIC CONTACTOR USING SAME

TECHNICAL FIELD

The present invention relates to a contact mechanism having a fixed contact and a movable contact inserted in a current path, and to an electromagnetic contactor that uses this contact mechanism, whereby a Lorentz force acting against an electromagnetic repulsion to separate the movable contact from the fixed contact is generated when the electromagnetic contactor is applied with a current.

BACKGROUND ART

As a contact mechanism for opening/closing a current path, there has conventionally been proposed a switch, such as a circuit breaker or an electromagnetic contactor. In such a switch that generates an arc when cutting off a current, a fixed contact applied thereto is folded into a U-shape as viewed laterally, and a fixed contact point is formed on the folded part of the U-shape. Furthermore, a movable contact point of a movable contact is disposed on this fixed contact point so as to be capable of contacting with and separating from the fixed contact point. The switch increases an opening speed of the movable contact by increasing an electromagnetic repulsion that acts on the movable contact when cutting off a large current, to drastically expand the arc (see Patent Literature 1, for example).

There has also been proposed a contact structure of an electromagnetic contactor in which a magnetic field generated by a flowing current drives an arc in the same configuration as the configuration described above (see Patent Literature 2, for example).

Patent Literature 1: Japanese Patent Application Publication No. 2001-210170

Patent Literature 2: Japanese Patent Application Publication No. H4-123719

Incidentally, the prior art described in Patent Literature 1 increases an electromagnetic repulsion that is generated by forming the fixed contact into a U-shape as viewed laterally. The increased electromagnetic repulsion consequently increases the opening speed of the movable contact to drastically expand the arc, the opening speed being obtained when cutting off a large current generated due to short circuit and the like. In this manner, the value of an accidental current can be restricted to a small value.

However, the electromagnetic contactor that is combined with a fuse or a circuit breaker to configure a circuit is required to inhibit the electromagnetic repulsion from opening the movable contact when a large current is applied thereto due to short circuit. The prior art described in Patent Literature 2, therefore, satisfies the requirement by increasing a spring force of a contact spring for ensuring a contact pressure of the movable contact on the fixed contact.

Disclosure of the Invention

Increasing the contact pressure of the contact spring as described above leads to the necessity of increasing a thrust that is generated by an electromagnet driving the movable contact, enlarging the entire configuration. Alternatively, the electromagnetic contactor needs to be combined with a fuse or a circuit breaker that provides a higher current-limiting effect and is excellent in cutoff performance.

The present invention, therefore, is conceived in view of the unsolved problems of the prior arts described above, and aims to provide a contact mechanism that is capable of, without enlarging the entire configuration thereof, preventing the generation of an electromagnetic repulsion that opens a movable contact upon application of a current, and also provide an electromagnetic contactor that uses this contact mechanism.

In order to achieve the object described above, a first aspect of a contact mechanism according to the present invention is a contact mechanism that has a fixed contact and a movable contact that are inserted in a current-carrying path. In this contact mechanism, at least either the fixed contact or the movable contact is shaped so as to increase a Lorentz force that acts against an electromagnetic repulsion in an opening direction, which is generated between the fixed contact and the movable contact upon application of a current.

According to this configuration, at least either the fixed contact or the movable contact is shaped into, for example, an L-shape or U-shape so as to generate the Lorentz force that acts against the electromagnetic repulsion in the opening direction, which is generated between the fixed contact and the movable contact upon application of a current. Therefore, the movable contact can be prevented from opening upon application of a large current.

Furthermore, in a second aspect of the contact mechanism according to the present invention, the movable contact has a conductive plate that is supported by a movable part and has contact point parts on both ends of a front or rear surface thereof. Moreover, in the contact mechanism, the fixed contact has L-shaped conductive plate parts formed by a pair of fixed contact point parts facing the contact point parts of the conductive plate, first conductive plate parts that support the pair of fixed contact point parts and extend outward from the both ends of the conductive plate in parallel with the conductive plate, and second conductive plate parts each extending from an outer end part of each of the first conductive plate parts through the outside of an end part of the conductive plate.

According to this configuration, while the movable contact has the conductive plate formed thereon, the fixed contact has the L-shaped conductive parts formed by the first conductive plate parts and the second conductive plate parts, wherein a relationship between a magnetic flux that is formed in the second conductive plate parts upon application of a current and a current flowing through the first conductive plate parts, leads to the generation of a large Lorentz force in a direction to contact the movable contact with the fixed contact, against the electromagnetic repulsion in the opening direction, which is generated between the fixed contact and the movable contact upon application of a current.

In addition, in a third aspect of the contact mechanism according to the present invention, the fixed contact is configured into a U-shape by including third conductive plate parts each extending inward from an end part of each of the second conductive plate parts in parallel with the conductive plate.

According to this configuration, currents flow in opposite directions through the first and third conductive parts, generating, between the conductive plate of the movable contact and the third conductive plate parts of the fixed contact, an electromagnetic repulsion in a direction bringing the movable contact into contact with the fixed contact.

In addition, in a fourth aspect of the contact mechanism according to the present invention, the movable contact has a conductive plate part supported by a movable part, U-shaped folded parts formed on both ends of the conductive plate part, and contact point parts each formed on an opposing surface of each of the U-shaped folded parts facing the conductive plate part. The fixed contact has L-shaped conductive plate parts configured by a pair of first conductive plate parts respectively formed with contact point parts to contact with the contact point parts of the movable contact that are disposed parallel to the conductive plate part in the U-shaped folded parts, and second conductive plate parts each extending from an inner end of each of the pair of first conductive plate parts through the inner side of an end part of each of the U-shaped folded parts.

According to this configuration, the U-shaped folded parts are formed in the movable contact, and, by using current paths in the U-shaped folded parts, an electromagnetic repulsion is generated between the conductive plate part of the movable contact and the first conductive plate parts of the fixed contact to bring the movable contact into contact with the fixed contact.

Moreover, the first aspect of the electromagnetic contactor according to the present invention has the contact mechanism of any one of the first to fourth aspects, wherein the movable contact is coupled to a movable core of an operating electromagnet, and the fixed contact is connected to an external connecting terminal.

According to this configuration, the spring force of a contact spring that brings the movable contact into contact with the fixed contact can be reduced by generating the Lorentz force that acts against the electromagnetic repulsion opening the space between the movable contact and the fixed contact upon application of a current to the electromagnetic contactor. Consequently, the thrust of the electromagnet driving the movable contact can be reduced, providing a small electromagnetic contactor.

The present invention can generate the Lorentz force that acts against an electromagnetic repulsion in an opening direction, which is generated between the fixed contact and the movable contact when a large current is applied to the contact mechanism that has the fixed contact and the movable contact inserted in a current-carrying path. Therefore, the present invention can reliably prevent the movable contact from being opened upon application of a large current, without using a mechanical pressure.

BEST MODE FOR CARRYING OUT THE INVENTION

Embodiments of the present invention are described hereinafter with reference to the drawings.

Figure 1:
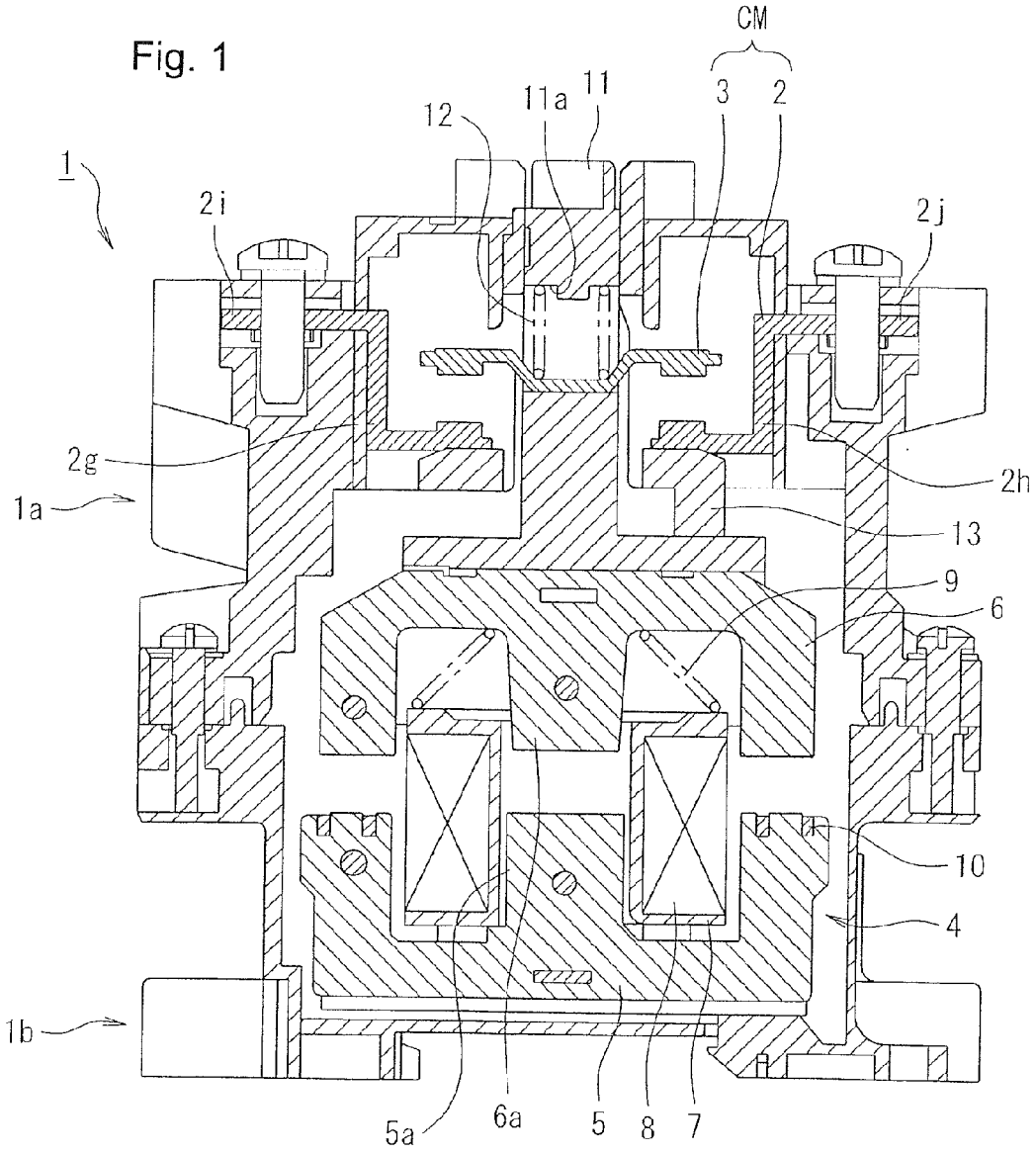
FIG. 1 is a cross-sectional view showing a first embodiment in which the present invention is applied to an electromagnetic contactor.
Figure 2A:
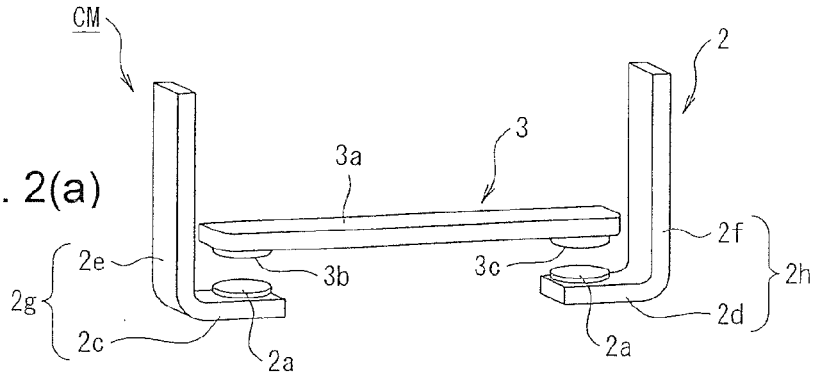
FIGS. 2(*a*)-2(*d*) are views showing a first embodiment of a contact mechanism of the present invention, wherein FIG. 2(*a*) is a perspective view, FIG. 2(*b*) is a cross-sectional view of the opened contact mechanism, FIG. 2(*c*) is a cross-sectional view of the closed contact mechanism, and FIG. 2(*d*) is a cross-sectional view showing a magnetic flux obtained when the contact mechanism is closed.
Figure 2B:
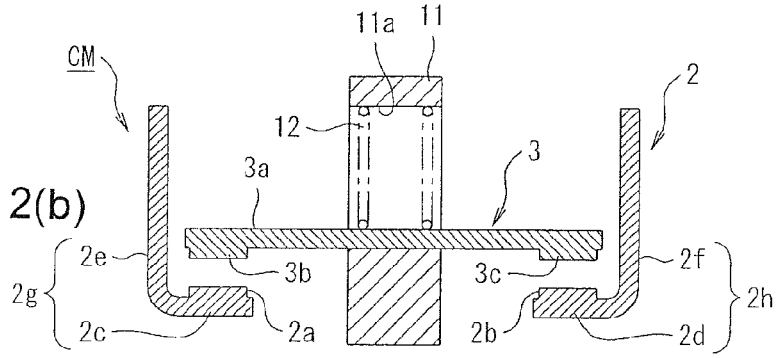
Figure 2C:
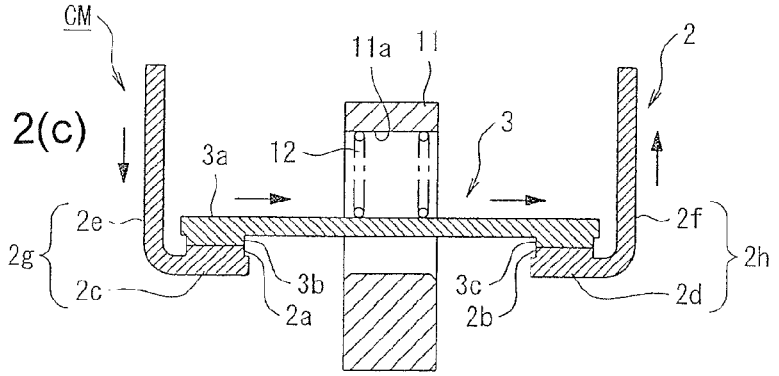
Figure 2D:
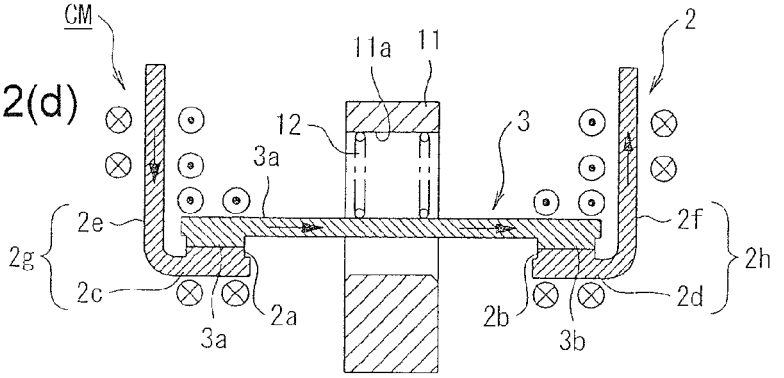

In FIG. 1, reference numeral 1 represents a main body case made from, for example, a synthetic resin. This main body case 1 has a divided structure composed of an upper case 1*a* and a lower case 1*b*. The upper case 1*a* is internally installed with a contact mechanism CM. This contact mechanism CM has a fixed contact 2 that is fixedly placed in the upper case 1*a*, and a movable contact 3 that is disposed so as to be able to come into contact with and separate from the fixed contact 2.

An operating electromagnet 4 for driving the movable contact 3 is disposed in the lower case 1*b*. In this operating electromagnet 4, a fixed core 5 formed from a stacked steel plate having E-shaped legs and a movable core 6 similarly formed from a stacked steel plate having E-shaped legs are placed face-to-face.

An electromagnetic coil 8 that is installed in a wrapped manner in a coil holder 7 and supplied with a single-phase AC is fixed to a central leg part 5*a* of the fixed core 5. Furthermore, a return spring 9 is disposed between an upper surface of the coil holder 7 and a root of a central leg 6*a* of the movable core 6 in order to urge the movable core 6 away from the fixed core 5.

Moreover, a shading coil 10 is embedded in an upper end surface of each outer leg part of the fixed core 5. Providing this shading coil 10 can prevent the occurrence of fluctuations, noise and vibrations of an electromagnetic attracting force, which can be caused due to a change in an alternating magnetic flux in a single-phase AC electromagnet.

A contact holder 11 is coupled to an upper end of the movable core 6. This contact holder 11 is held by an insertion hole 11*a* that is formed at an upper end of the contact holder 11 in an axially perpendicular direction, in a manner that the movable contact 3 is pressed downward against the fixed contact 2 by a contact spring 12 to obtain a predetermined contact pressure.

As shown in the enlarged diagrams in FIGS. 2(*a*)-2(*d*), this movable contact 3 is configured by an elongated rod-shaped conductive plate 3*a*, a central part of which is pressed by the contact spring 12. Movable contact point parts 3*b*, 3*c* are formed at both ends of a lower surface of this conductive plate 3*a*.

Also, as shown in the enlarged diagrams in FIG. 2(*a*)-2(*d*), the fixed contact 2 has L-shaped conductive plate parts 2*g*, 2*h*, which are formed by first conductive plate parts 2*c*, 2*d* that extend outward in parallel with the conductive plate 3*a* while supporting a pair of fixed contact point parts 2*a*, 2*b* facing lower sides of the movable contact point parts 3*b*, 3*c* of the movable contact 3, and second conductive plate parts 2*e*, 2*f* that extend upward through the outsides of end parts of the conductive plate 3*a* from outer end parts of the first conductive plate parts 2*c*, 2*d* outside the conductive plate 3*a*. Then, as shown in FIG. 1, external connecting terminals 2*i*, 2*j* extending and fixed on the outside of the upper case 1*a* are coupled to upper ends of the L-shaped conductive plate parts 2*g*, 2*h*.

Operations of the above-described first embodiment are described next.

When the electromagnetic coil 8 of the operating electromagnet 4 is in a non-conductive state, no electromagnetic attracting force is generated between the fixed core 5 and the movable core 6, and, consequently, the movable core 6 is urged by the return spring 9 to move upward away from the fixed core 5. The upper end of the movable core 6 is then abutting with a stopper 13 and accordingly held at a current cutoff position.

In a state in which the movable core 6 is held at the current cutoff position, the contact spring 12 brings the movable contact 3 into contact with a bottom part of the insertion hole 11*a* of the contact holder 11, as shown in FIG. 2(*b*). In such a state, the movable contact point parts 3*b*, 3*c* formed on the ends of the conductive plate 3*a* of the movable contact 3 separate upward from the fixed contact point parts 2*a*, 2*b* of the fixed contact 2, obtaining an opened state of the contact mechanism CM.

In this opened state of the contact mechanism CM, when a single-phase AC is supplied to the electromagnetic coil 8 of the operating electromagnet 4, an attracting force is generated between the fixed core 5 and the movable core 6, attracting the movable core 6 downward against the return spring 9. As a result, the movable contact 3 supported by the contact holder 11 descends, whereby the movable contact point parts 3*b*, 3*c* are contacting with the fixed contact point parts 2*a*, 2*b* of the fixed contact 2 by the contact pressure of the contact spring 12, obtaining a closed state of the contact mechanism CM.

In this closed state, a large current of approximately, for example, several tens of kA, which is input from the external connecting terminal 2*i* of the fixed contact 2 connected to a DC power source (not shown), is supplied to the movable contact point part 3*b* of the movable contact 3 via the second conductive plate part 2*e*, the first conductive plate part 2*c*, and the fixed contact point part 2*a*. The large current supplied to the movable contact point part 3*b* is supplied to the fixed contact point part 2*b* via the conductive plate 3*a* and the movable contact point part 3*c*. The large current supplied to the fixed contact point part 2*b* is supplied to the first conductive plate part 2*d*, the second conductive plate part 2*f*, and the external connecting terminal 2*j*, forming a current-carrying path supplied to an external load.

At this moment, an electromagnetic repulsion is generated in a direction of opening the movable contact point part 3*b*, 3*c*, between each of the fixed contact point parts 2*a*, 2*b* of the fixed contact 2 and each of the movable contact point parts 3*b*, 3*c* of the movable contact 3.

However, because the fixed contact 2 has the L-shaped conductive plate parts 2*g*, 2*h* formed by the first conductive plate parts 2*c*, 2*d* and the second conductive plate parts 2*e*, 2*f* as shown in FIG. 2, the fixed contact 2 forms a magnetic field shown in FIG. 2(*d*) with respect to the current flowing through the movable contact 3, due to the formation of the current path described above. For this reason, according to Fleming's left-hand rule, the Lorentz force acting against the abovementioned electromagnetic repulsion can be generated in the conductive plate 3*a* of the movable contact 3 to push the movable contact point parts 3*b*, 3*c* against the fixed contact point parts 2*a*, 2*b*.

Therefore, even when the electromagnetic repulsion that opens the movable contact 3 is generated, the Lorentz force acting against this electromagnetic repulsion can be generated, reliably preventing the movable contact 3 from being opened. Consequently, the pressure of the contact spring 12 supporting the movable contact 3 can be reduced, and therefore a thrust that is generated in the operating electromagnet 4 can also be reduced. As a result, the size of the entire configuration can be reduced.

In this case, it is only necessary to form the L-shaped conductive plate parts 2*g*, 2*h* in the fixed contact 2, so that the fixed contact 2 can be processed easily. In addition, it is not necessary to produce an additional member for generating an electromagnetic force or mechanical force acting against the abovementioned electromagnetic repulsion. Therefore, not only the number of components but also the size of the entire configuration can be prevented from growing.

Next, a second embodiment of the present invention is described with reference to FIGS. 3(*a*)-3(*c*).

In the second embodiment, the Lorentz force acting against the abovementioned electromagnetic repulsion is generated on the back of the movable contact, the electromagnetic repulsion being generated with respect to the fixed contact and the movable contact.

Figure 3A:
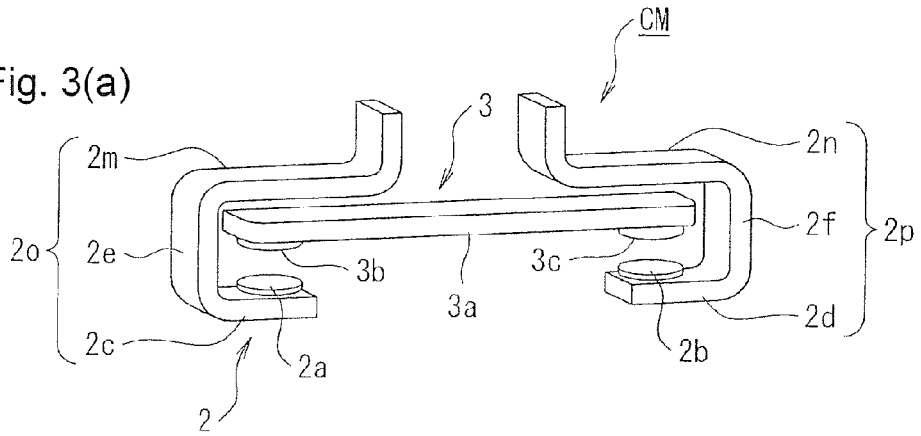
FIGS. 3(*a*)-3(*c*) are views showing a second embodiment of the contact mechanism of the present invention, wherein FIG. 3(*a*) is a perspective diagram, FIG. 3(*b*) is a cross-sectional diagram of the opened contact mechanism, and FIG. 3(*c*) is a cross-sectional diagram of the closed contact mechanism.
Figure 3B:
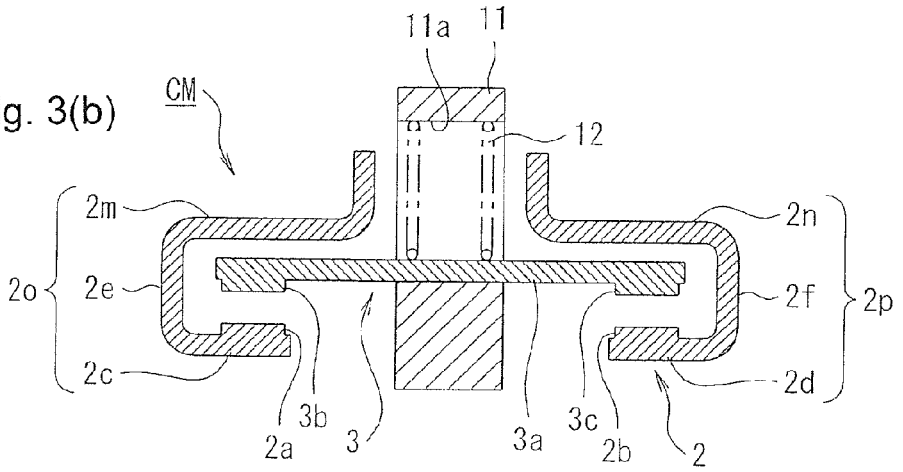
Figure 3C:
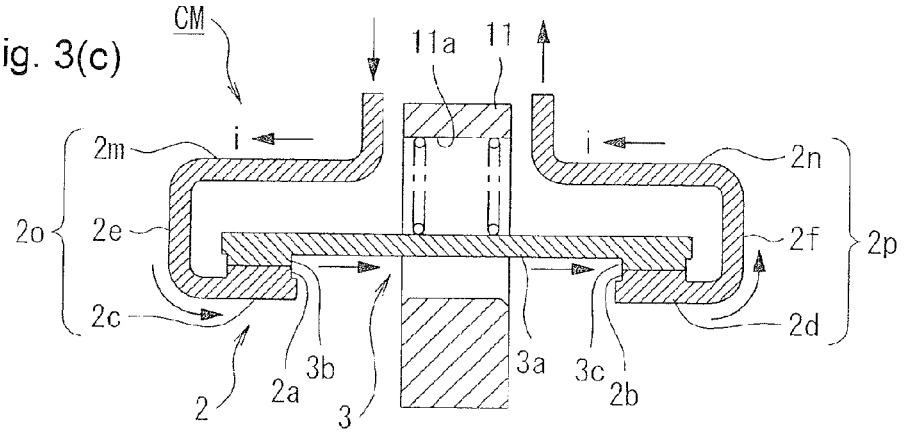

In other words, the second embodiment has the same configuration as that of the first embodiment, except that the second embodiment has a configuration shown in FIGS. 3(*a*)-3(*c*) in which, according to the configuration of the first embodiment shown in FIG. 2(*a*)-2(*d*), the second conductive plate parts 2*e*, 2*f* of the L-shaped conductive plate parts 2*g*, 2*h* of the fixed contact 2 are bent so as to cover upper ends of the end parts of the conductive plate 3*a* of the movable contact 3 to form third conductive plate parts 2*m*, 2*n* parallel to the conductive plate 3*a*, thereby configuring U-shaped conductive parts 2*o*, 2*p*.

According to the second embodiment, when the electromagnetic coil 8 of the operating electromagnet 4 is in a non-conductive state, no attracting force acts between the fixed core 5 and the movable core 6. Therefore, as with the first embodiment described above, the movable core 6 and the contact holder 11 are urged upward by the spring force of the return spring 9, obtaining an opened state of the contact mechanism CM, as shown in FIG. 3(*b*).

In the opened state of the contact mechanism CM, when a single-phase AC is applied to the electromagnetic coil 8 of the operating electromagnet 4, an attracting force is generated in the fixed core 5, attracting the movable core 6 downward against the return spring 9. As a result, the contact holder 11 descends, and the movable contact point parts 3*b*, 3*c* of the movable contact 3 are contacting with the fixed contact point parts 2*a*, 2*b* of the fixed contact 2 by the contact pressure of the contact spring 12 as shown in FIG. 3(*c*), obtaining a closed state of the contact mechanism CM.

When the contact mechanism CM enters the closed state, a large current of approximately, for example, several tens of kA, which is input from the external connecting terminal 2*i* of the fixed contact 2 connected to the DC power source (not shown), is supplied to the movable contact point part 3*b* of the movable contact 3 via the third conductive plate part 2*m*, the second conductive plate part 2*e*, the first conductive plate part 2*c*, and the fixed contact point part 2*a*. The large current supplied to the movable contact point part 3*b* is supplied to the fixed contact point part 2*b* via the conductive plate 3*a* and the movable contact point part 3*c*. The large current supplied to the fixed contact point part 2*b* is supplied to the first conductive plate part 2*d*, the second conductive plate part 2*f*, the third conductive plate part 2*n*, and the external connecting terminal 2*j*, forming a current-carrying path supplied to an external load.

At this moment, an electromagnetic repulsion is generated in a direction of opening the movable contact point parts 3*b*, 3*c*, between each of the fixed contact point parts 2*a*, 2*b* of the fixed contact 2 and each of the movable contact point parts 3*b*, 3*c* of the movable contact 3.

However, because the fixed contact 2 has the U-shaped conductive plate parts 2*o*, 2*p* formed by the first conductive plate parts 2*c*, 2*d*, the second conductive plate parts 2*e*, 2*f* and the third conductive plate parts 2*m*, 2*n* as shown in FIG. 3, currents flow in opposite directions in the third conductive plate parts 2*m*, 2*n* of the fixed contact 2 and the conductive plate 3*a* of the movable contact 3 that faces the third conductive plate parts 2*m*, 2*n*. For this reason, based on the relationship of magnetic fields formed by the third conductive plate parts 2*m*, 2*n* of the fixed contact 2 to the current flowing through the conductive plate 3*a* of the movable contact 3, the Lorentz force pushing the conductive plate 3*a* of the movable contact 3 against the fixed contact point parts 2*a*, 2*b* of the fixed contact 2 can be generated according to Fleming's left-hand rule. This Lorentz force can act against the abovementioned electromagnetic repulsion in the opening direction, which is generated between each of the fixed contact point parts 2*a*, 2*b* of the fixed contact 2 and each of the movable contact point parts 3*b*, 3*c* of the movable contact 3, preventing the movable contact point parts 3*b*, 3*c* of the movable contact 3 from being opened.

In the second embodiment as well, the simple configuration of forming the U-shaped conductive plate parts 2*o*, 2*p* in the fixed contact 2 can easily generate the Lorentz force that acts against the abovementioned electromagnetic repulsion in the opening direction, which is generated between the fixed contact 2 and the movable contact 3. Therefore, the same effects as those described in the first embodiment can be obtained.

Next, a third embodiment of the present invention is described with reference to FIGS. 4(*a*)-4(*c*).

Unlike the second embodiment, the third embodiment forms U-shaped folded parts in the movable contact.

Figure 4A:
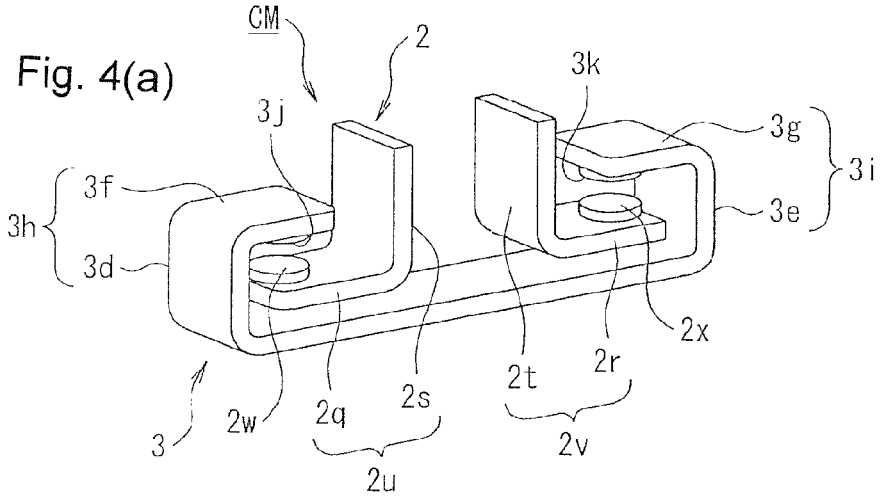
FIGS. 4(*a*)-4(*c*) are views showing a third embodiment of the contact mechanism of the present invention, wherein FIG. 4(*a*) is a perspective view, FIG. 4(*b*) is a cross-sectional view of the opened contact mechanism, and FIG. 4(*c*) is a cross-sectional view of the closed contact mechanism.
Figure 4B:
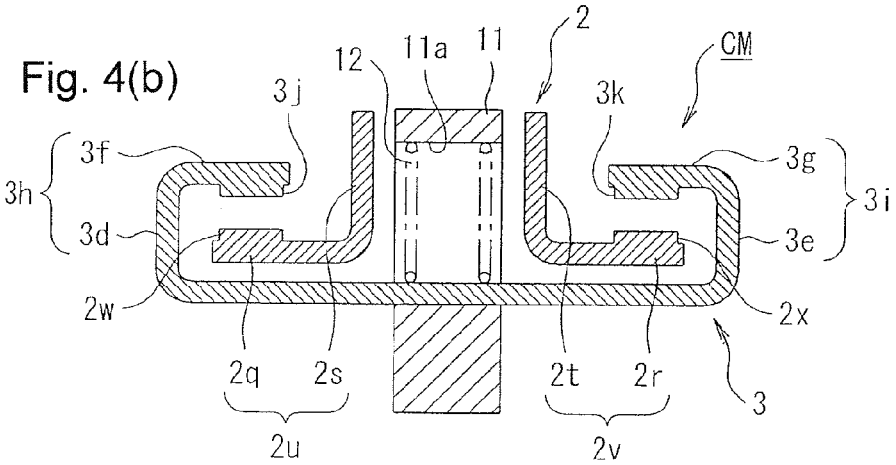
Figure 4C:
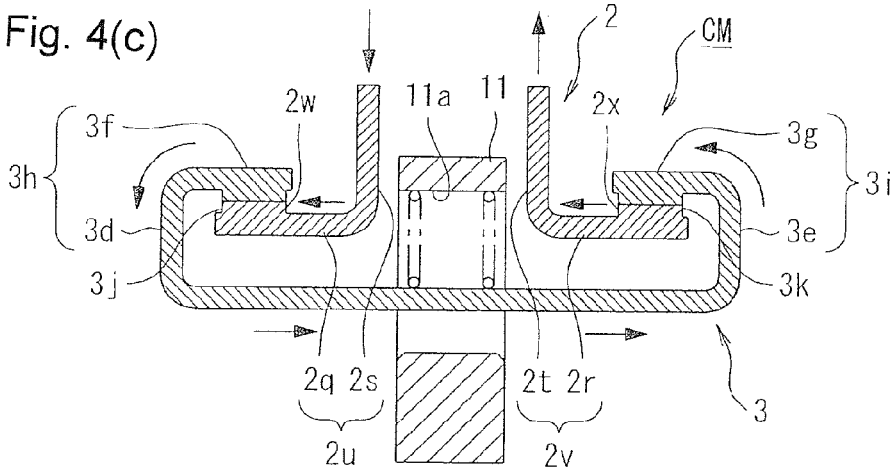
Figure 5A:
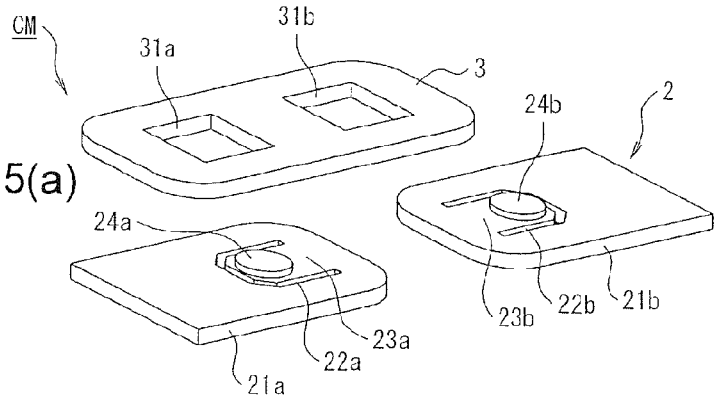
FIGS. 5(*a*)-5(*d*) are views showing a fourth embodiment of the present invention, wherein FIG. 5(*a*) is a perspective view, FIG. 5(*b*) is a cross-sectional view of the opened contact mechanism, FIG. 5(*c*) is a cross-sectional view of the closed contact mechanism, and FIG. 5(*d*) is an explanatory view showing a current direction obtained when the contact mechanism is closed.
Figure 5B:
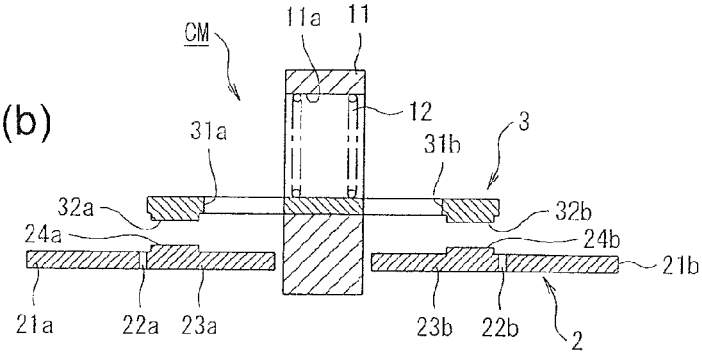
Figure 5C:
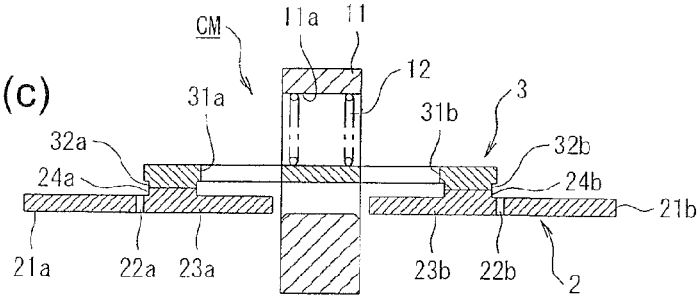
Figure 5D:
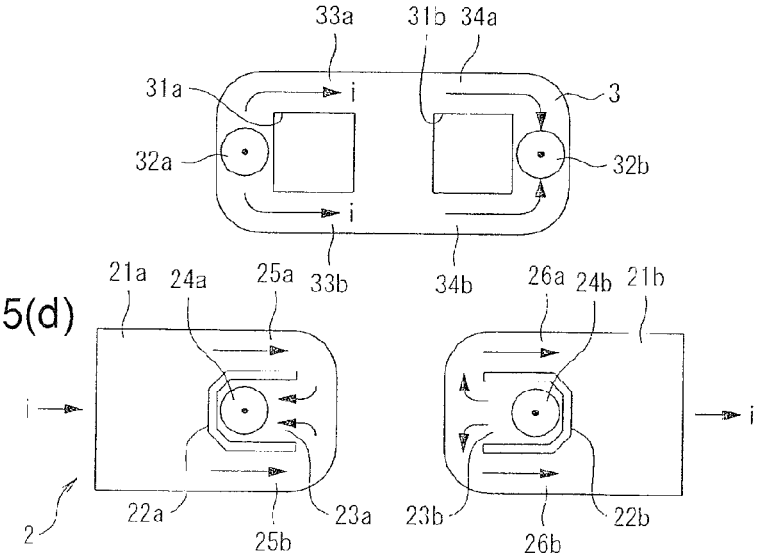

In other words, in the third embodiment, U-shaped folded parts 3*h*, 3*i* that are folded above the conductive plate 3*a* are formed by first conductive plate parts 3*d*, 3*e* extending upward from the ends of the conductive plate 3*a* of the movable contact 3 and second conductive plate parts 3*f*, 3*g* that extend inward from upper ends of the first conductive plate parts 3*d*, 3*e*, as shown in FIGS. 4(*a*) to 4(*c*). Movable contact point parts 3*j*, 3*k* are formed on lower surfaces of tip ends of the second conductive plate parts 3*f*, 3*g* of these U-shaped folded parts 3*h*, 3*i*.

Furthermore, in an opened state of the contact mechanism CM, the fixed contact 2 has L-shaped conductive plate parts 2*u*, 2*v*, which are formed by fourth conductive plate parts 2*q*, 2*r* that extend inward facing the conductive plate 3*a* and the second conductive plate parts 3*f*, 3*g* configuring the U-shaped folded parts 3*h*, 3*i* of the movable contact 3, and fifth conductive plate parts 2*s*, 2*t* that extend upward from internal ends of the fourth conductive plate parts 2*q*, 2*r* through the insides of inner end parts of the U-shaped folded parts 3*h*, 3*i* of the movable contact 3. In addition, the fourth conductive plate parts 2*q*, 2*r* have fixed contact point parts 2*w*, 2*x* that are formed so as to face the movable contact point parts 3*j*, 3*k* of the movable contact 3.

According to the third embodiment, when the electromagnetic coil 8 of the operating electromagnet 4 is in a non-conductive state, the movable core 6 is moved upward by the return spring 9, whereby the contact holder 11 comes into abutment with the stopper 13. At this moment, in the contact mechanism CM, the conductive plate 3*a* of the movable contact 3 is abutting with the bottom part of the insertion hole 11*a* by the contact spring 12, as shown in FIG. 4(*b*). Furthermore, the fourth conductive plate parts 2*q*, 2*r* of the fixed contact 2 are positioned in middle parts between the conductive plate 3*a* and the second conductive plate parts 3*f*, 3*g* configuring the U-shaped folded parts 3*h*, 3*i*, thereby separating the fixed contact point parts 2*w*, 2*x* downward from the movable contact point parts 3*j*, 3*k*. As a result, the contact mechanism CM enters the opened state.

In the opened state of the contact mechanism CM, when a single-phase AC is applied to the electromagnetic coil 8 of the operating electromagnet 4, the fixed core 5 attracts the movable core 6 against the return spring 9. As a result, the contact holder 11 descends. Consequently, the movable contact point parts 3*j*, 3*k* of the movable contact 3 contact with the fixed contact point parts 2*w*, 2*x* of the fixed contact 2, obtaining a closed state of the contact mechanism CM, as shown in FIG. 4(*c*).

When the contact mechanism CM enters the closed state, a large current of approximately, for example, several tens of kA, which is input from the external connecting terminal 2*i* of the fixed contact 2 connected to the DC power source (not shown), is supplied to the movable contact point part 3*j* of the movable contact 3 via the fifth conductive plate part 2*s*, the fourth conductive plate part 2*q*, and the fixed contact point part 2*w*. The large current supplied to the movable contact point part 3*j* is supplied to the fixed contact point part 2*x* via the second conductive plate part 3*f*, the first conductive plate part 3*d*, the conductive plate 3*a*, the first conductive plate part 3*e*, the second conductive plate part 3*g*, and the movable contact point part 3*k*. As a result, a current-carrying path is formed in which the large current supplied to the fixed contact point part 2*x* is supplied to an external load via the fourth conductive plate part 2*r*, the fifth conductive plate part 2*t*, and the external connecting terminal 2*j*.

At this moment, an electromagnetic repulsion is generated in a direction of opening the movable contact point parts 3*i*, 3*k*, between each of the fixed contact point parts 2*w*, 2*x* of the fixed contact 2 and each of the movable contact point parts 3*j*, 3*k* of the movable contact 3.

However, because the movable contact 3 has the U-shaped folded parts 3*h*, 3*i* formed by the conductive plate 3*a*, the first conductive plate parts 3*d*, 3*e*, and the second conductive plate parts 3*f*, 3*g* as shown in FIGS. 4(*a*)-4(*c*), currents flow in opposite directions in the conductive plate 3*a* of the movable contact 3 and the fourth conductive plate parts 2*q*, 2*r* of the fixed contact 2. For this reason, the current flowing through the conductive plate 3*a* of the movable contact 3 and magnetic fields formed by the fourth conductive plate parts 2*q*, 2*r* of the fixed contact 2 can generate the Lorentz force in the conductive plate 3*a* to push the movable contact point parts 3*j*, 3*k* of the movable contact 3 against the fixed contact point parts 2*w*, 2*x* of the fixed contact 2, as shown in FIG. 4(*c*). This Lorentz force can act against the abovementioned electromagnetic repulsion in the opening direction, which is generated between each of the fixed contact point parts 2*w*, 2*x* of the fixed contact 2 and each of the movable contact point parts 3*j*, 3*k* of the movable contact 3, preventing the movable contact point parts 3*j*, 3*k* of the movable contact 3 from being opened upon application of a large current.

Also, in the third embodiment, because the L-shaped conductive plate parts 2*u*, 2*v* are formed in the fixed contact 2, a magnetic flux reinforcement part is formed above the second conductive plate parts 3*f*, 3*g* of the movable contact 3 by the fifth conductive plate parts 2*s*, 2*t* of the L-shaped conductive plate parts 2*u*, 2*v*. For this reason, the Lorentz force similar to that of the first embodiment described above can be generated, more strongly preventing the movable contact 3 from being opened.

Next, a fourth embodiment of the present invention is described with reference to FIGS. 5(*a*)-5(*d*).

In the fourth embodiment, the fixed contact and the movable contact are formed into flat plates to generate the Lorentz force acting against the electromagnetic repulsion in the opening direction.

In other words, in the fourth embodiment, the fixed contact 2 and the movable contact 3 that configure the contact mechanism CM are formed into flat plates, as shown in FIGS. 5(*a*) to 5(*d*). The fixed contact 2 has flat conductors 21*a*, 21*b* that are disposed at a regular interval and have rectangular shapes as viewed planarly. These flat conductors 21*a*, 21*b* are formed to be line-symmetric. U-shaped grooves 22*a*, 22*b*, whose open end surfaces form internal end surfaces, are pierced on the front and back of flat conductors 21*a*, 21*b* so as to face longitudinal end parts of the movable contact 3. Fixed contact point part 24*a*, 24*b* are formed on opposing surfaces of plate parts 23*a*, 23*b* that face the movable contact 3 and are surrounded by the U-shaped grooves 22*a*, 22*b*.

In the movable contact 3, on the other hand, square through-holes 31*a*, 31*b* are formed at a regular interval in positions that face the plate parts 23*a*, 23*b* surrounded by the U-shaped groves 22*a*, 22*b* of the flat conductors 21*a*, 21*b* of the fixed contact 2. Movable contact point parts 32*a*, 32*b* are formed on lower surfaces of external end parts of the through-holes 31*a*, 31*b* that face the fixed contact point parts 24*a*, 24*b* of the fixed contact 2.

According to the fourth embodiment, as with the first to third embodiments described above, when the electromagnetic coil 8 of the operating electromagnet 4 is in a non-conductive state, the movable core 6 is moved upward by the return spring 9. Therefore, the contact holder 11 is moved upward to a position shown in FIG. 5(*b*). Consequently, the flat conductors 21*a*, 21*b* of the fixed contact 2 separate from the movable contact 3, and the fixed contact point parts 24*a*, 24*b* of the flat conductors 21*a*, 21*b* separate from the movable contact point parts 32*a*, 32*b*, obtaining an opened state of the contact mechanism CM.

In the opened state of the contact mechanism CM, when a single-phase AC is supplied to the electromagnetic coil 8 of the operating electromagnet 4, the fixed core 5 attracts the movable core 6 against the return spring 9. As a result, the contact holder 11 descends. Consequently, the fixed contact point parts 24*a*, 24*b* of the fixed contact 2 of the contact mechanism CM contact with the movable contact point parts 32*a*, 32*b* of the movable contact 3, obtaining a closed state of the contact mechanism CM.

In the closed state of the contact mechanism CM, a large current of, for example, a DC power source is input from the external connecting terminal 2*i* to a left end of the flat conductor 21*a*. Because the fixed contact point part 24*a* is formed in the plate part 23*a* surrounded by the U-shaped groove 22*a*, the large current that is input to the flat conductor 21*a* enters the plate part 23*a* via side plate parts 25*a*, 25*b* formed on either side surface of the U-shaped groove 22*a*, and is supplied from the fixed contact point part 24*a* to the movable contact point part 32*a* of the movable contact 3.

The large current supplied to the movable contact point part 32*a* passes through side plate parts 33*a*, 33*b* formed on either side surface of the through-hole 31*a*, and is supplied from the movable contact point part 32*b* to the fixed contact point part 24*b* of the flat conductor 21*b* via side plate parts 34*a*, 34*b* formed on either side surface of the through-hole 31*b*.

The large current supplied to the fixed contact point part 24*b* passes through side plate parts 26*a*, 26*b* formed on either side surface of the U-shaped groove 22*b*, from the plate part 23*b*, and is supplied from a right end of the flat conductor 21*b* to a load via the external connecting terminal 2*j*.

At this moment, currents flow in the same direction in the side plate parts 25*a*, 25*b* of the flat conductor 21*a* of the fixed contact 2 and the side plate parts 33*a*, 33*b* of the movable contact 3, the side plate parts 25*a*, 25*b* and the side plate parts 33*a*, 33*b* facing each other. Similarly, currents flow in the same direction in the side plate parts 34*a*, 34*b* of the movable contact 3 and the side plate parts 26, 26*b* of the flat conductor 21*b* of the fixed contact 2, the side plate parts 34*a*, 34*b* and the side plate parts 26*a*, 26*b* facing each other.

Therefore, according to Fleming's left-hand rule, downward Lorentz force is generated in the side plate parts 33*a*, 33*b* and 34*a*, 34*b* of the movable contact 3. This Lorentz force can prevent an electromagnetic repulsion in an opening direction from being generated between each of the fixed contact point parts 24*a*, 24*b* and each of the movable contact point parts 32*a*, 32*b*, preventing the movable contact 3 from being opened. Thus, the same effects as those described in the first to third embodiments can be obtained.

Note that each of the embodiments has described the AC excitation of the operating electromagnet 4; however, an operating electromagnet for DC excitation may be applied. Moreover, the drive mechanism for the movable contact point 3 is not limited to the configurations described above, and a drive mechanism with any configuration can be applied.

In addition, each of the embodiments has described a situation where the contact mechanism CM of the present invention is applied to an electromagnetic contactor. However, the present invention is not limited thereto, and the contact mechanism CM can be applied to any equipment such as a switch.

INDUSTRIAL APPLICABILITY

The present invention can provide a contact mechanism, in which at least a fixed contact or a movable contact is configured so as to generate a Lorentz force that acts against an electromagnetic repulsion in an opening direction that is generated in the fixed contact or the movable contact upon application of a large current, and which is capable of preventing the movable contact from being opened upon application of a large current. The present invention can also provide an electromagnetic contactor that uses this contact mechanism.

EXPLANATION OF REFERENCE NUMERALS

1 . . . Main body case, 1*a* . . . Upper case, 1*b* . . . Lower case, 2 . . . Fixed contact point, 2*a*, 2*b* . . . Fixed contact point part, 2*c*, 2*d* . . . First conductive plate part, 2*e*, 2*f* . . . Second conductive plate part, 2*g*, 2*h* . . . L-shaped conductive plate part, 2*i*, 2*j* . . . External connecting terminal, 2*m*, 2*n* . . . Third conductive plate part, 2*o*, 2*p* . . . U-shaped conductive plate part, 2*q*, 2*r* . . . Fourth conductive plate part, 2*s*, 2*t* . . . Fifth conductive plate part, 2*u*, 2*v* . . . L-shaped conductive plate part, 2*w*, 2*x* . . . Fixed contact point part, 3 . . . Movable contact, 3*a* . . . Conductive plate part, 3*b*, 3*c* . . . Movable contact point part, 3*d*, 3*e* . . . First conductive plate part, 3*f*, 3*g* . . . Second conductive plate part, 3*h*, 3*i* . . . U-shaped folded part, 3*j*, 3*k* . . . Movable contact point part, 4 . . . Operating electromagnet, 5 . . . Fixed core, 6 . . . Movable core, 8 . . . Electromagnetic coil, 9 . . . Return spring, 11 . . . Contact holder, 12 . . . Contact spring, 13 . . . Stopper, 21*a*, 21*b* . . . Flat conductor, 22*a*, 22*b* . . . U-shaped groove, 23*a*, 23*b* . . . Plate part, 24*a*, 24*b* . . . Fixed contact point part, 31*a*, 31*b* . . . Through-hold, 41 . . . Power line, 42 . . . Arrester, 43 . . . U-shaped folded part

What is claimed is:

1. A contact mechanism, comprising:

a movable contact comprising a first movable contact point part on a longitudinal end of the movable contact, a second movable contact point part on another longitudinal end of the movable contact, a first through-hole on a longitudinal inner side of the first movable contact point part, a second through-hole on a longitudinal inner side of the second movable contact point part, a first pair of side plate parts extending on outer sides of the first movable contact point part and the first through-hole, and a second pair of side plate parts extending on outer sides of the second movable contact point part and the second through-hole; and a fixed contact comprising a first plate part comprising a first fixed contact point part, a second plate part comprising a second fixed contact point part, a first U-shaped groove surrounding the first fixed contact point part, a second U-shaped groove surrounding the second fixed contact point part, a third pair of side plate parts on outer sides of the first U-shaped groove, and a fourth pair of side plate parts on outer sides of the second U-shaped groove, wherein the first movable contact point part faces the first fixed contact point part, the second movable contact point part faces the second fixed contact point part, and a current flows in a same direction in the first pair of side plate parts and the third pair of side plate parts, and the current flows in a same direction in the second pair of side plate parts and the fourth pair of side plate parts to generate a Lorentz force acting against an electromagnetic repulsion in an opening direction generated between the fixed contact and the movable contact upon conduction of the current.

2. An electromagnetic contactor, comprising:

the contact mechanism according to claim 1, wherein the movable contact is coupled to a movable core of an operating electromagnet, and the fixed contact is connected to an external connecting terminal.

* * * * *